US009604829B2

(12) United States Patent
Matsumoto

(10) Patent No.: US 9,604,829 B2
(45) Date of Patent: Mar. 28, 2017

(54) LIFTING APPARATUS

(71) Applicant: HIRATA CORPORATION, Shinagawa-ku (JP)

(72) Inventor: Bungo Matsumoto, Shinagawa-ku (JP)

(73) Assignee: HIRATA CORPORATION, Shinagawa-Ku, Tokyo (JP)

( * ) Notice: Subject to any disclaimer, the term of this patent is extended or adjusted under 35 U.S.C. 154(b) by 378 days.

(21) Appl. No.: 14/104,560

(22) Filed: Dec. 12, 2013

(65) Prior Publication Data

US 2014/0097568 A1 Apr. 10, 2014

Related U.S. Application Data

(63) Continuation of application No. PCT/JP2011/003929, filed on Jul. 8, 2011.

(51) Int. Cl.
*B66F 7/02* (2006.01)

(52) U.S. Cl.
CPC ..... *B66F 7/02* (2013.01); *B66F 7/025* (2013.01)

(58) Field of Classification Search
CPC ..... B23Q 1/64; B66F 7/28; B25B 5/102
USPC ..... 269/58, 86, 56, 37, 172, 163, 157, 151, 269/142, 140, 132, 128, 118, 110, 98, 90, 269/89, 254 CS, 254 R, 160, 48.4, 214, 269/212, 194, 193, 192, 68, 25, 2, 73, 182, 269/43, 156, 70, 71, 60, 45, 147, 283, 219

See application file for complete search history.

(56) References Cited

U.S. PATENT DOCUMENTS 2,319,377 A * 5/1943 Wallace ..... B25B 5/02 112/114
2,656,864 A * 10/1953 Hopfeld ..... B25B 5/102 269/147
2,875,912 A * 3/1959 Thresher ..... B66F 9/125 100/100
3,218,058 A * 11/1965 Smith ..... B25B 5/02 269/166

(Continued)

FOREIGN PATENT DOCUMENTS

JP H05132143 A 5/1993
JP 07-010264 A 1/1995

(Continued)

OTHER PUBLICATIONS

SCARA mit Stocker of Hirata Corp from wikipedia.*

(Continued)

*Primary Examiner* — Larry E Waggle, Jr.
*Assistant Examiner* — Mahdi H Nejad
(74) *Attorney, Agent, or Firm* — Buchanan Ingersoll & Rooney PC

(57) ABSTRACT

This invention provides a lifting apparatus which holds a work by clamping the work vertically, and lifts the work. The lifting apparatus includes upper and lower clamping units, a guide mechanism which guides lifting movements of the upper and lower clamping units, a driving mechanism which drives the lower clamping unit to lift along the guide mechanism, and a stopper which is set so that the upper clamping unit is stopped before the lower clamping unit reaches a downward movement lower limit during the downward movement of the units, and which defines a downward movement lower limit of the upper clamping unit.

9 Claims, 9 Drawing Sheets

(56) References Cited

U.S. PATENT DOCUMENTS

| | | | | | |
|---|---|---|---|---|---|
| 3,455,476 | A * | 7/1969 | Grigsby | B66F 9/18 | 294/103.1 |
| 3,510,923 | A * | 5/1970 | Blake | A61B 17/0206 | 24/528 |
| 3,520,527 | A * | 7/1970 | Persson | B25B 1/103 | 269/182 |
| 3,604,745 | A * | 9/1971 | Sinclair | B66F 9/184 | 294/104 |
| 5,456,567 | A * | 10/1995 | Luebke | B66F 9/125 | 187/240 |
| 5,595,375 | A * | 1/1997 | Bennhausen | B25B 5/04 | 269/229 |
| 6,338,478 | B2 * | 1/2002 | Baculy | 269/147 | |
| 6,402,131 | B1 * | 6/2002 | Baculy | B25B 1/205 | 269/147 |
| 8,042,240 | B2 * | 10/2011 | Mitsui | B23Q 3/18 | 198/346.2 |
| 8,382,417 | B2 | 2/2013 | Yoshida et al. | | |
| 9,102,017 | B2 * | 8/2015 | Bentschneider | B23P 19/04 | |
| 2006/0045710 | A1 * | 3/2006 | Hiebert | B66F 7/28 | 414/631 |
| 2011/0057373 | A1 * | 3/2011 | Sueoka | G01M 13/04 | 269/56 |
| 2015/0060240 | A1 * | 3/2015 | Peutl | B65C 9/04 | 198/803.3 |
| 2015/0246431 | A1 * | 9/2015 | Shute | B25B 5/163 | 144/195.4 |

FOREIGN PATENT DOCUMENTS

| | | | |
|---|---|---|---|
| JP | 10-025029 | A | 1/1998 |
| JP | 2000-016778 | * | 1/2000 |
| JP | 2000-016778 | A | 1/2000 |
| JP | 2000-016778 TD | * | 1/2000 |
| JP | 2006-263860 | A | 10/2006 |
| JP | 2010076002 | A | 4/2010 |
| KR | 20080043726 | A | 5/2008 |

OTHER PUBLICATIONS

Hirata Auto Stocker from Hirata webpage http://www.hirata.com/products/autostocker.htm.*

International Search Report (PCT/ISA/210) mailed on Sep. 13, 2011, by the Japanese Patent Office as the International Searching Authority for International Application No. PCT/JP2011/003929.

Written Opinion (PCT/ISA/237) mailed on Sep. 13, 2011, by the Japanese Patent Office as the International Searching Authority for International Application No. PCT/JP2011/003929.

Office Action issued on Sep. 25, 2014, by the Japanese Patent Office in corresponding Japanese Patent Application No. 2013-523704.

Office Action issued on Jan. 22, 2015, by the Korean Patent Office in corresponding Korean Patent Application No. 10-2013-7034569.

* cited by examiner

LIFTING APPARATUS

This application is a continuation of International Patent Application No. PCT/JP2011/003929 filed on Jul. 8, 2011, the entire content of which is incorporated herein by reference.

BACKGROUND OF THE INVENTION

Field of the Invention

The present invention relates to a lifting apparatus for lifting a work.

Description of the Related Art

A production system, which temporarily lifts up a work from a conveyor line, and executes an operation by an operation machine upon execution of various operations for the work conveyed on the conveyor line, is known (for example, Japanese Patent Laid-Open No. 2006-263860).

A lifting apparatus which lifts a work with respect to a conveyance line is required to hold/release the work in addition to lifting of the work. When driving sources such as motors are respectively required to lift and hold/release the work, the mechanism of the lifting apparatus is complicated, and cost is unwantedly increased. When the mechanism of the lifting apparatus is complicated, it is difficult to perform an operation for a work from behind of the lifting apparatus, and the workability for the work often impairs. Also, a layout space of an operation machine can only be assured in a space above the lifting apparatus, and the degrees of freedom in layout of the operation machine may often lower.

SUMMARY OF THE INVENTION

An object of the present invention is to provide a lifting apparatus which can lift and hold/release a work by a simpler arrangement.

According to the present invention, there is provided a lifting apparatus for holding a work by clamping the work vertically, and lifting the work, the apparatus comprising: an upper clamping unit which is brought into contact with the work from above; a lower clamping unit which is brought into contact with the work from below; a guide mechanism which guides lifting movements of the upper clamping unit and the lower clamping unit; a driving mechanism which drives the lower clamping unit to lift along the guide mechanism; and a stopper which is set so that the upper clamping unit is stopped before the lower clamping unit reaches a downward movement lower limit during the downward movement of the upper clamping unit and the lower clamping unit, and which defines a downward movement lower limit of the upper clamping unit.

DESCRIPTION OF THE EMBODIMENTS

Figure 1:
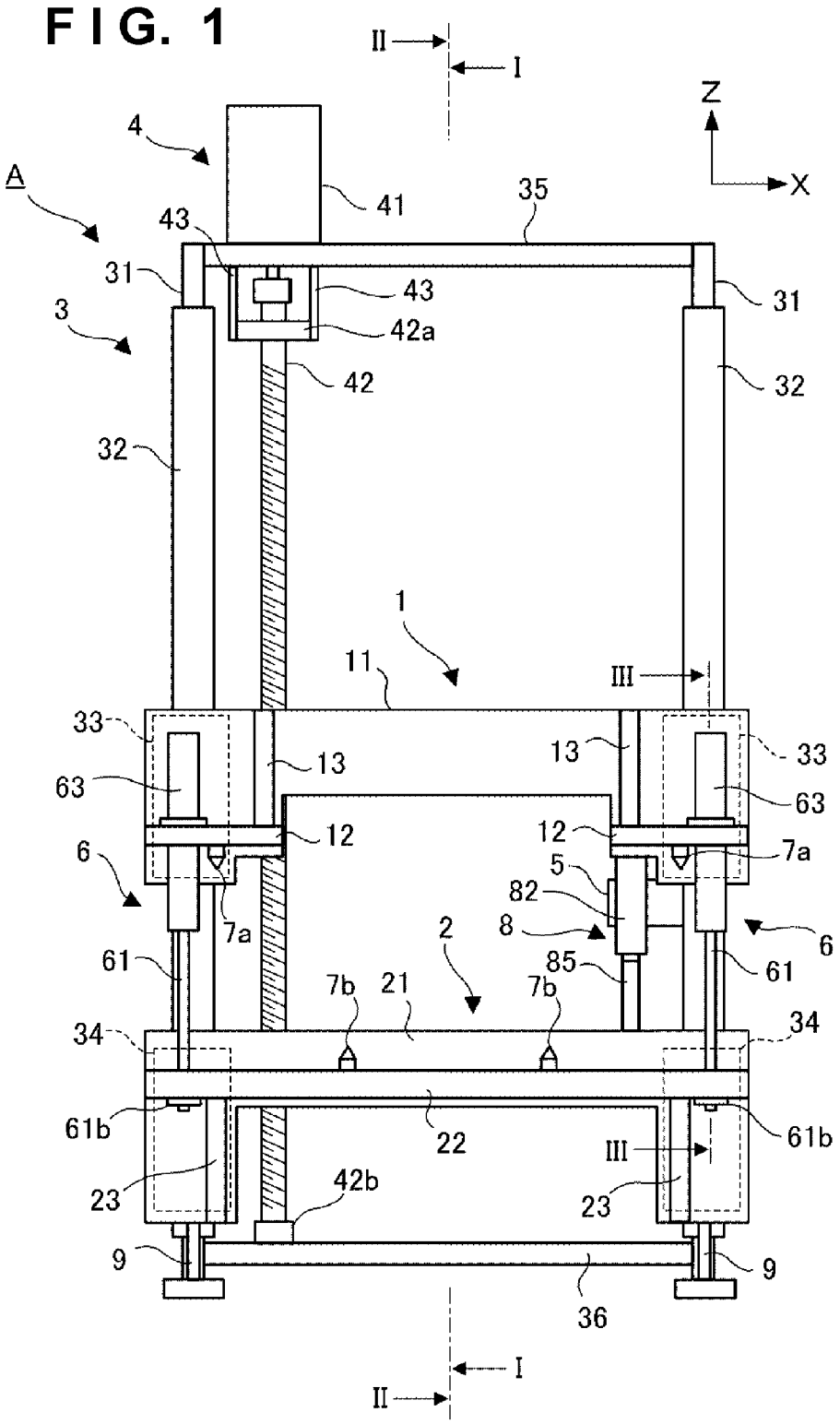
FIG. 1 is a front view of a lifting apparatus according to one embodiment of the present invention.
Figure 2:
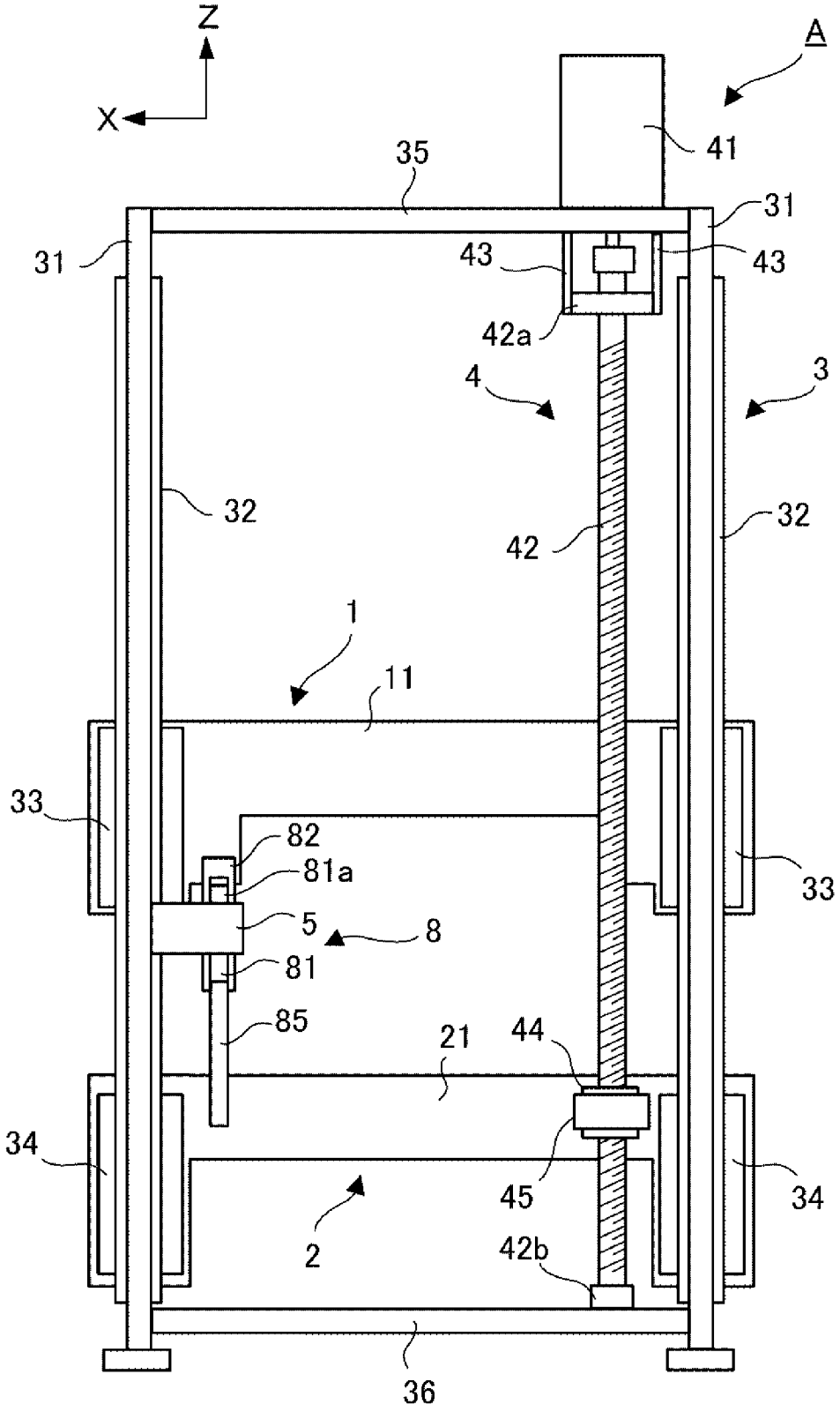
FIG. 2 is a rear view of the lifting apparatus.
Figure 3:
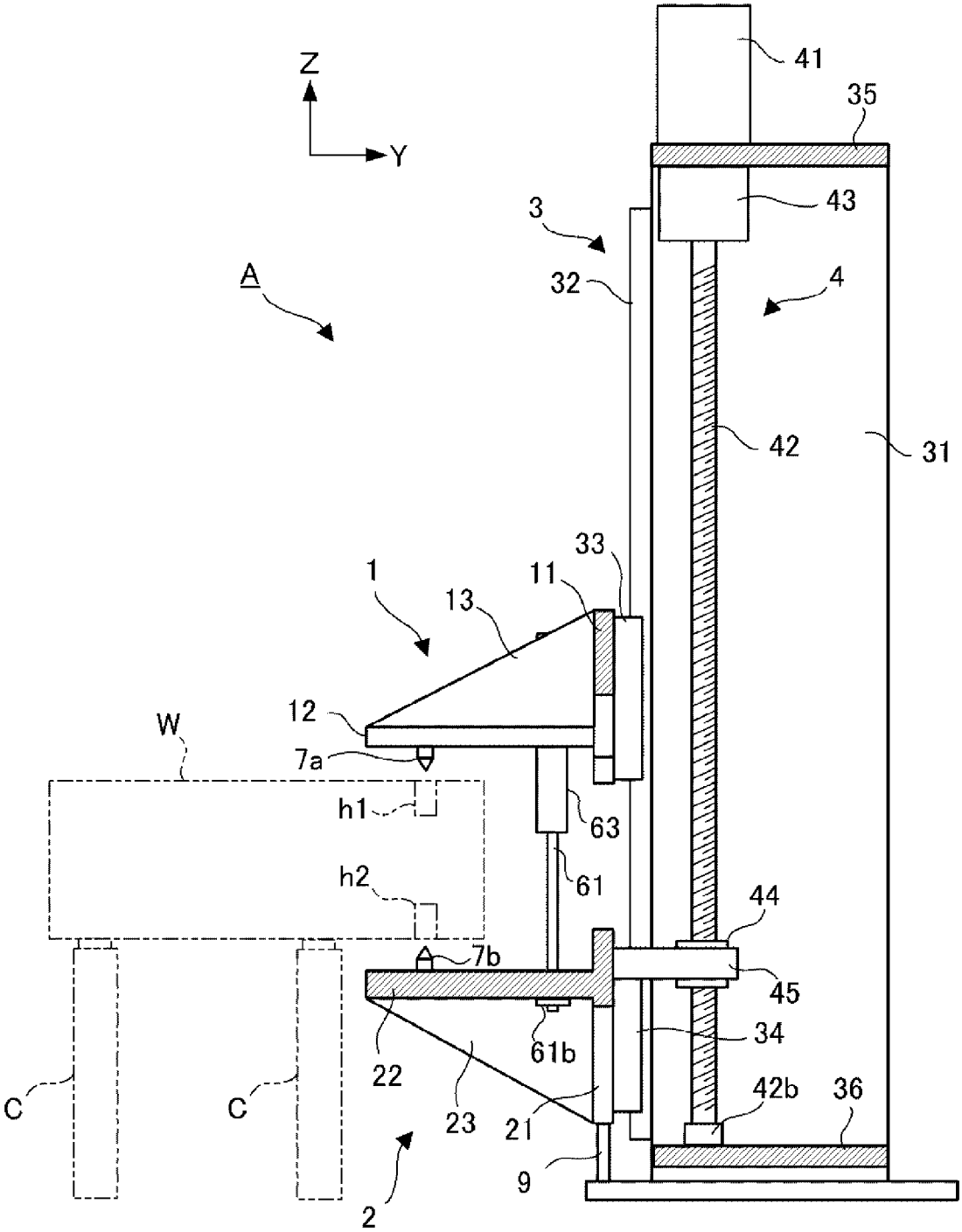
FIG. 3 is a sectional view taken along a line I-I in FIG. 1.
Figure 4:
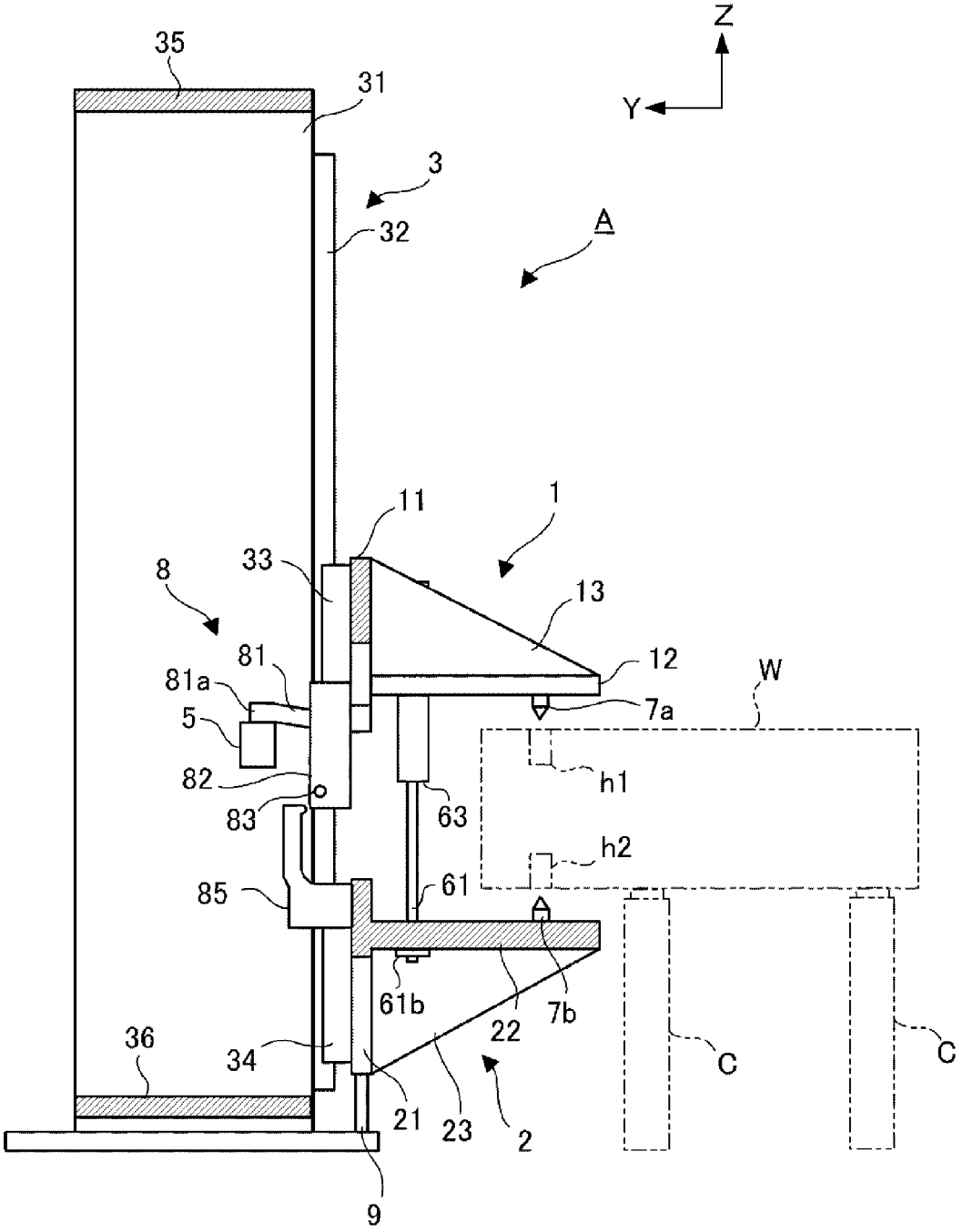
FIG. 4 is a sectional view taken along a line II-II in FIG. 1.

FIG. 1 is a front view of a lifting apparatus A according to one embodiment of the present invention, FIG. 2 is a rear view of the lifting apparatus A, FIG. 3 is a sectional view taken along a line I-I in FIG. 1, and FIG. 4 is a sectional view taken along a line II-II in FIG. 1. Note that in respective figures, an arrow Z indicates an up-down direction (vertical direction), and arrows X and Y indicate horizontal directions, which are orthogonal to each other. The Y direction agrees with a depth direction of the lifting apparatus A. Also, FIGS. 3 and 4 show an example of a work W to be lifted by the lifting apparatus A and its conveyor C. The conveyor C conveys the work W in the X direction.

The lifting apparatus A is an apparatus which vertically clamps and holds the work W conveyed on the conveyor C, and lifts the held work W. The lifting apparatus A includes an upper clamping unit 1, lower clamping unit 2, guide mechanism 3, driving mechanism 4, and stoppers 5 and 9.

The upper clamping unit 1 includes a main body portion 11, abutting portion 12, and reinforcing portion 13. The main body portion 11 is a plate-like member, a plane direction of which is defined by the Z and X directions. Each abutting portion 12 is a plate-like member which is connected to the main body portion 11 to protrude from a front surface of the main body portion 11, and a plane direction of which is defined by the X and Y directions. The lower surface of each abutting portion 12 abuts against the work W from above. The abutting portion 12 is arranged at two positions to be spaced apart from each other in the X direction. Each reinforcing portion 13 is a plate-like member which is connected to both the main body portion 11 and the abutting portion 12 to reinforce the abutting portion 12, and a plane direction of which is defined by the Z and Y directions.

The lower clamping unit 2 includes a main body portion 21, abutting portion 22, and reinforcing portion 23. The main body portion 21 is a plate-like member, a plane direction of which is defined by the Z and X direction. The abutting portion 22 is a plate-like member, which is connected to the main body portion 21 to protrude from a front surface of the main body portion 21, and a plane direction of which is defined by the X and Y directions. The abutting portion 22 is arranged to oppose the abutting portion 12, and its upper surface abuts against the work W from below. Each reinforcing portion 23 is a plate-like member, which is connected to both the main body portion 21 and the abutting portion 22 to reinforce the abutting portion 22, and a plane direction of which is defined by the Z and Y directions.

The upper clamping unit 1 and lower clamping unit 2 are respectively provided with positioning portions 7*a* and 7*b*, which respectively engage with the work W. In case of this embodiment, the positioning portions 7*a* and 7*b* are pin members, a distal end of which has a conical shape. The positioning portions 7*a* and 7*b* engage with the work W when they are inserted into holes h1 and h2 formed in the work W, thereby positioning the work W with respect to the lifting apparatus A. Note that pin members may be formed on the work W side, and holes may be formed in the upper clamping unit 1 and lower clamping unit 2. Furthermore, the present invention is not limited to the pin members and holes as long as a structure can position the work W.

The positioning portion 7*a* are provided to protrude downward from the lower surfaces of the abutting portion 12, and are spaced apart from each other in the X direction.

The positioning portion 7*b* is provided to protrude upward from the upper surface of the abutting portion 22, and are spaced apart from each other in the X direction.

The guide mechanism 3 guides lifting movements (movements in the Z direction) of the upper clamping unit 1 and lower clamping unit 2. The guide mechanism 3 includes a pair of column portions 31, a pair of rail portions 32, and sliders 33 and 34.

The pair of column portions 31 are plate-like members, which stand to be spaced apart from each other in the X direction, and a plane direction of which is defined by the Z and X directions. Upper and lower portions of the pair of column portions 31 are respectively coupled via a top plate portion 35 and bottom plate portion 36. The rail portions 32 are respectively fixed to the front surfaces of the column portions 31, and extend in the Z direction. The sliders 33 and 34 engage with the rail portions 32, and slide along the rail portions 32.

The sliders 33 are respectively fixed to two end portions in the X direction of the main body portion 11 of the upper clamping unit 1, and guide movements in the Z direction of the upper clamping unit 1. The sliders 34 are respectively fixed to two end portions in the X direction of the main body portion 21 of the lower clamping unit 2, and guide movements in the Z direction of the lower clamping unit 2.

In this embodiment, the guide mechanism 3 adopts a double-mast type structure in which the pair of rail portions 32 are spaced apart from each other in the right-left direction, and are supported by the pair of column portions 31 which are similarly spaced apart from each other in the right-left direction.

In this embodiment, the rail portions 32 are configured by rail members common to the sliders 33 and 34. That is, the lifting movements of the upper clamping unit 1 and lower clamping unit 2 are guided by common rail members. This contributes to a reduction of the number of parts and a simple structure. However, an arrangement in which rail members are respectively provided to the upper clamping unit 1 and lower clamping unit 2 can also be adopted.

The driving mechanism 4 drives the lower clamping unit 2 to lift along the guide mechanism 3. The upper clamping unit 1 merely lifts integrally with the lower clamping unit 2 within a given range, and the lifting apparatus A does not have any driving mechanism for solely lifting the upper clamping unit 1. As will be described below, in this embodiment, the driving mechanism 4 is configured by a ball screw mechanism, but can adopt other types of mechanisms.

The driving mechanism 4 includes a driving unit 41, ball screw shaft 42, and ball nut 44. The driving unit 41 is supported by the top plate portion 35, and includes, for example, a motor or a combination of a motor and reduction gear. The ball screw shaft 42 extends in the Z direction, its upper and lower end portions are respectively rotatably supported by bearings 42*a* and 42*b*.

The bearing 42*a* is supported by the top plate portion 35 via support members 43, and the bearing 42*b* is supported by the bottom plate portion 36. The ball screw shaft 42 is arranged not at the center between the pair of column portions 31 but at a position closer to one column portion 31 side. This is because a space required for an operation machine to access the work W is broadened when the operation machine of the work W is arranged on the back side of the lifting apparatus A. Thus, upon execution of an operation from the back side of the lifting apparatus A for the work W which is located on the front surface side of the lifting apparatus A, the operation can be executed for the work W via the space between the pair of column portions 31. That is, the operation machine of the work W can be arranged on the back side of the lifting apparatus A, and can execute operations such as processing and assembling of parts for the work W.

An output shaft of the driving unit 41 is coupled to the upper end portion of the ball screw shaft 42 via the top plate portion 35, and rotates the ball screw shaft 42. The ball nut 44 threadably engages with the ball screw shaft 42, and they configure a ball screw mechanism. The ball nut 44 is rotatably supported by a support member 45, which is fixed to the back surface of the main body portion 21 of the lower clamping unit 2. Therefore, when the driving unit 41 rotates the ball screw shaft 42, the lower clamping unit 1 is moved upward or downward depending on a rotation direction of the ball screw shaft 42.

The stopper 5 defines a downward movement lower limit of the upper clamping unit 1, and the stoppers 9 define a downward movement lower limit of the lower clamping unit 2. All of FIGS. 1 to 4 illustrate a state in which the upper clamping unit 1 and lower clamping unit 2 are respectively located at their downward movement lower limits.

The stopper 5 protrudes laterally (in a direction of the other opposing column portion 31 side) from the inner side surface of one column portion 31. A lever member 81 is provided to the upper clamping unit 1, and is brought into contact with the stopper 5, thereby restricting the downward movement of the upper clamping unit 1.

The position of the stopper 5 is set so that the upper clamping unit 1 stops before the lower clamping unit 2 reaches the downward movement lower limit at the time of downward movements of the upper clamping unit 1 and lower clamping unit 2. In this embodiment, during a process for moving the lower clamping unit 2 upward from its downward movement lower limit, the lower clamping unit 2 is brought into contact with the work W first, and the work W integrated with the lower clamping unit 2 is then brought into contact with the upper clamping unit 1, thereby clamping and holding the work W by the upper clamping unit 1 and lower clamping unit 2.

Then, during a process for moving the upper clamping unit 1, which is located above the downward movement lower limit, downward integrally with the lower clamping unit 2, the upper clamping unit 1 alone is stopped by the stopper 5 to space apart the upper clamping unit 1 and lower clamping unit 2 from each other, thus releasing clamping (holding) of the work W. Thus, the position of the stopper 5 is set so that a position spaced apart by at least an up-down width of the work W matches the downward movement lower limit of the upper clamping unit 1 with respect to the lower clamping unit 2 which is located at the downward movement lower limit. Then, by defining the downward movement lower limit of the upper clamping unit 1 by the stopper 5 in this way, the need for any driving source (motor and the like) required to hold and release the work W can be obviated upon holding the work W by being clamped between the upper clamping unit 1 and lower clamping unit 2. As a result, the work W can be lifted and held/released by a simpler arrangement, that is, by only one driving source.

Figure 5:
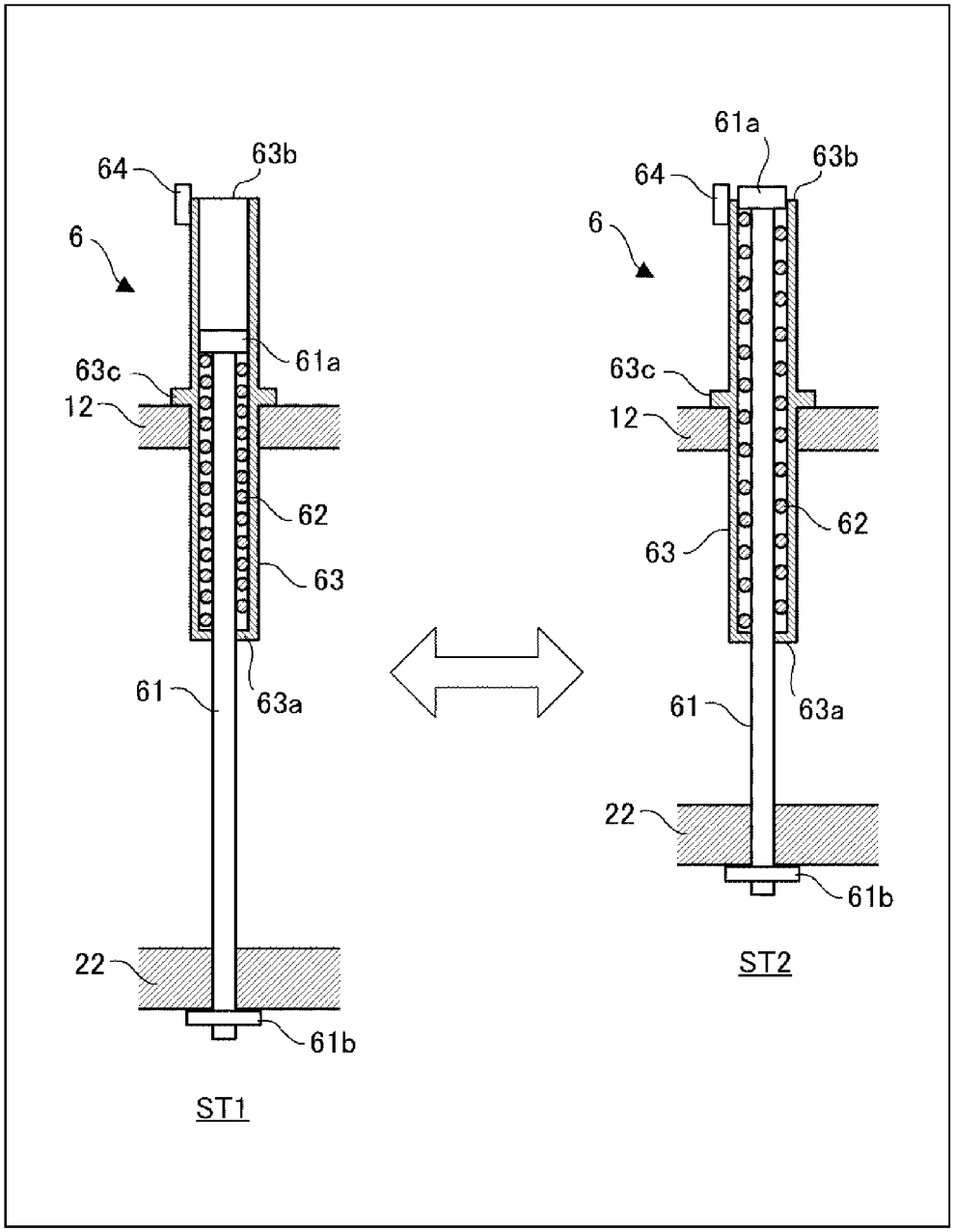
FIG. 5 is an explanatory view of a coupling mechanism.

A clamping force of the upper clamping unit 1 and lower clamping unit 2 with respect to the work W can use the self weight of the upper clamping unit 1, but when the work W becomes heavier, it is difficult to maintain a clamping state. Thus, in this embodiment, a coupling mechanism 6 is arranged to assure a stronger clamping force. FIG. 5 is an explanatory view of the coupling mechanism 6, and corresponds to a sectional view taken along a line III-III of FIG. 1.

The coupling mechanism 6 includes a rod 61, biasing member 62, and cylinder 63. The rod 61 extends in the vertical direction through the abutting portion 12 of the upper clamping unit 1. The lower end portion of the rod 61 is attached to the lower clamping unit 2. In case of this embodiment, the lower end portion of the rod 61 passes through the abutting portion 22 of the lower clamping unit 2, and is attached to the abutting portion 22 since a fixing member 61*b* is arranged.

The upper end portion of the rod 61 protrudes from the upper clamping unit 1, and is provided with a flange member 61*a*. The flange member 61*a* is a to-be-biased member which receives a biasing force from the biasing member 62. In this embodiment, this to-be-biased member is configured by the flange member 61*a*, but any other arrangements may be used as long as they can receive a biasing force. For example, a fixing portion to which an end portion of the biasing member 62 is fixed may be used.

The cylinder 63 is a bottomed hollow member, which has a bottom portion 63*a* formed with an opening through which the rod 61 passes, and a top portion 63*b* of which is open. In this embodiment, the cylinder 63 has a cylindrical shape. In case of this embodiment, the cylinder 63 extends through the abutting portion 12 of the upper clamping unit 1, is attached so that a flange portion 63*c* formed on the middle outer circumference of the cylinder 63 contacts the upper surface of the abutting portion 12, and extends above and below the abutting portion 12.

In the cylinder 63, the rod 61 and flange member 61*a* are inserted, and the biasing member 62 is housed in its inner space. In case of this embodiment, the biasing member 62 is a coil spring, which is loaded between the flange portion 61*a* and bottom portion 63*a*, and in which the rod 61 is inserted. The biasing member 62 biases the flange portion 61*a* and bottom portion 63*a*, and also the flange portion 61*a* and abutting portion 12 in a direction to be separated from each other. As a result, the biasing member 62 always applies a biasing force between the upper clamping unit 1 and lower clamping unit 2 in a direction to approach each other. Then, this force serves as a clamping force required to clamp the work W.

In FIG. 5, a state ST1 indicates a state of the coupling mechanism 6 when the abutting portion 12 of the upper clamping unit 1 and the abutting portion 22 of the lower clamping unit 2 are spaced apart by a largest distance, and a state ST2 shows a state of the coupling mechanism 6 when the abutting portion 12 of the upper clamping unit 1 and the abutting portion 22 of the lower clamping unit 2 are closest to each other. The state ST2 is a state when the work W is clamped. This state ST2 has a smaller compression amount of the biasing member 62 than the state ST1, but has a sufficiently compressed state, and the biasing member 62 applies the biasing force between the upper clamping unit 1 and lower clamping unit 2 in a direction to approach each other. In the state ST2, the flange portion 61*a* protrudes upward from the top portion 63*b* of the cylinder 63.

A sensor 64 is that which detects a position of the flange member 61*a* with respect to the cylinder 63, and is, for example, an optical sensor or mechanical switch. In case of this embodiment, the sensor 64 is attached to the cylinder 63, and detects whether or not the flange portion 61*a* protrudes from the top portion 63*b* of the cylinder 63. When protrusion of the flange portion 61*a* is detected, it can be judged that the work W is normally clamped by the upper clamping unit 1 and lower clamping unit 2; when protrusion is not detected, it can be judged that the work W is not clamped or a foreign matter is clamped (error).

Note that in this embodiment, the biasing member 62 as a coil spring is loaded between the flange portion 61*a* and bottom portion 63*a*. However, the present invention is not limited to this. For example, an arrangement in which the biasing member 62 is loaded between the flange portion 61*a* and the upper surface of the abutting portion 12 may be adopted. Also, in this embodiment, the coil spring is used as the biasing member 62. Alternatively, other elastic members such as a rubber member may be used. Furthermore, as the biasing member 62, an air dumper and the like can be adopted in addition to the elastic member.

Figure 6:
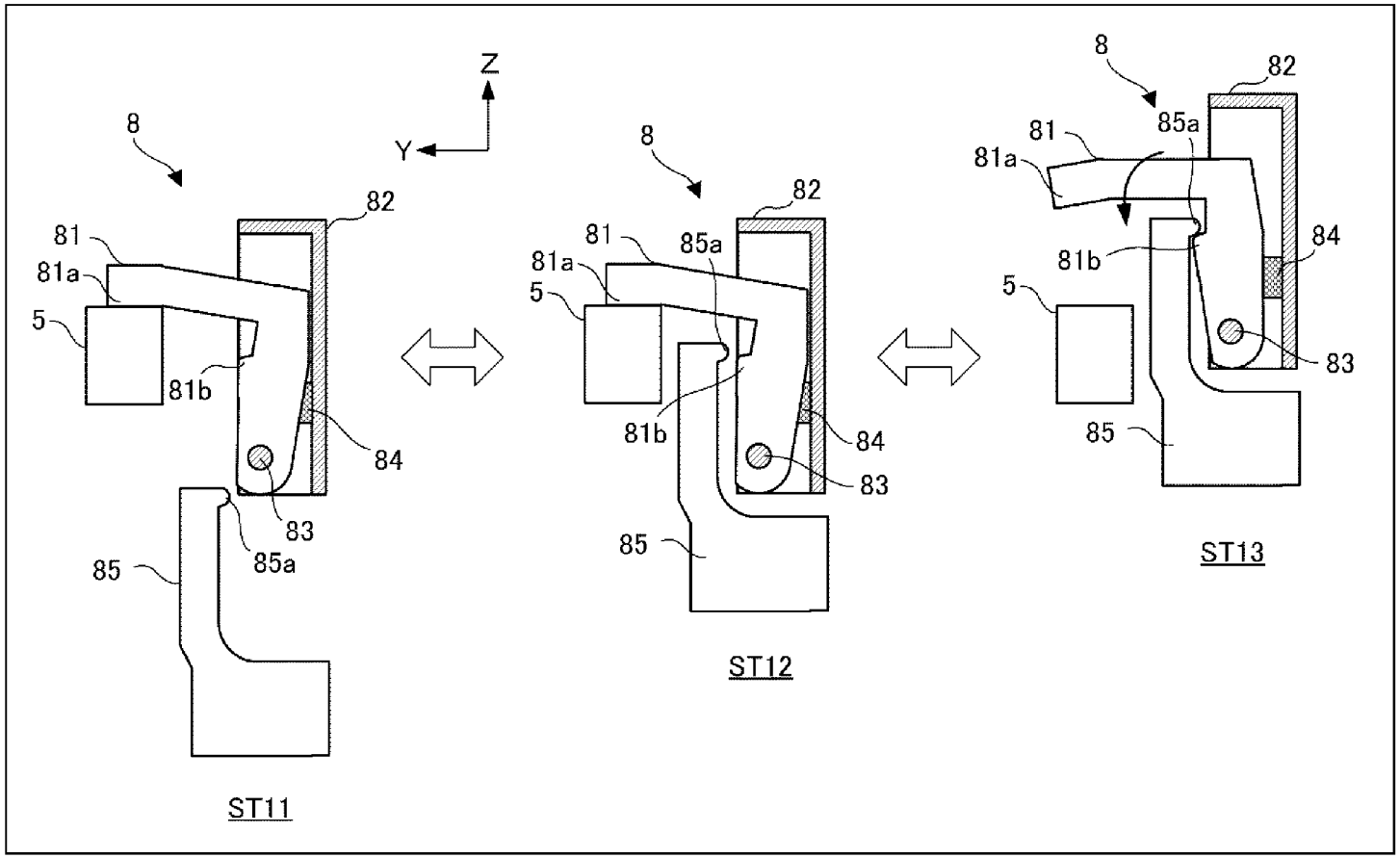
FIG. 6 is an explanatory view of an engaging mechanism.

When the coupling mechanism 6 assures the clamping force of the upper clamping unit 1 and lower clamping unit 2 with respect to the work W, if the upper clamping unit 1 and lower clamping unit 2 are separated from each other to release clamping during clamping of the work W, the work W may be dropped and damaged. Thus, in this embodiment, as a fail safe mechanism, an engaging mechanism 8 which mechanically engages the upper clamping unit 1 and lower clamping unit 2 during clamping of the work W is arranged. FIG. 6 is an explanatory view of the engaging mechanism 8.

As engagement between the upper clamping unit 1 and lower clamping unit 2, an engaging state has to be maintained during clamping of the work W, and has to be released when clamping is released. Thus, in this embodiment, a portion where the upper clamping unit 1 contacts the stopper 5 is used as a lever member 81, and clamping/releasing of the work W and engaging/releasing are synchronized by engagement between this lever member 81 and lower clamping unit 2.

Referring to FIGS. 4 and 6, the engaging mechanism 8 includes the lever member 81, a support member 82 which pivotally supports the lever member 81, and an engaging member 85.

The support member 82 is a housing having an open back surface (left side surface in FIGS. 6 and 7) and an open lower portion, and is fixed to the back surface (a surface on the opposite side to a surface facing the work W) of the main body portion 11 of the upper clamping unit 1. A shaft 83, which extends in the X direction, is attached to the lower portion of the support member 82. The lever member 81 is supported by this shaft 83 and is to be pivotal about the shaft 83.

A biasing member 84 is arranged between the lever member 81 and an inner wall of the support member 82. The biasing member 84 is a member which always biases the lever member 81 in a direction to incline the lever member 81 to the back surface side, and is, for example, an elastic member such as a spring or rubber.

The lever member 81 is formed to be bent in an L shape, and one end portion of the lever member 81 is supported by the shaft 83, while the other end portion thereof protrudes to the back surface side to serve as an abutting portion 81*a*, which abuts against the stopper 5. Also, the lever member 81 has an engaging portion (dent portion) 81*b* at the bent portion.

The engaging member 85 is also formed to be bent in an L shape, and one end portion of the engaging member 85 is fixed to the back surface of the main body portion 21 of the lower clamping unit 2, while the other end portion thereof protrudes upward. An upper end portion of the other end portion has a pawl-like engaging portion 85*a* which engages with the engaging portion 81*b*. When the engaging portion 85*a* engages with the engaging portion 81*b*, the upper clamping unit 1 and lower clamping unit 2 can be mechanically engaged with each other.

FIG. 6 shows three states ST11 to ST13 of the engaging mechanism 8. The state ST13 indicates an engaging state of the engaging portions 81*b* and 85*a*, and this position of the lever member 81 is called an initial position. The lever member 81 pivots between this initial position and a contact position shown in the states ST11 and ST12 in which the lever member 81 pivots upward from this initial position. In the states ST11 and ST12, the lever member 81 has a posture inclined from the initial position to the front surface side.

The state ST11 indicates a state in which the upper clamping unit 1 and lower clamping unit 2 are respectively located at their downward movement lower limits. The downward movement of the upper clamping unit 1 is restricted since the stopper 5 contacts the abutting portion 81*a* of the lever member 81. The lever member 81 is located at the contact position.

The state ST12 indicates a state in which the lower clamping unit 2 moves upward from its downward movement lower limit, mounts the work W, and begins to further mount the upper clamping unit 1. At this time, the engaging portions 85*a* and 81*b* are located at nearly the same level.

The state ST13 indicates a state in which the lower clamping unit 2 is further moving upward to mount the work W and upper clamping unit 1. When the upper clamping unit 1 is moved upward, the stopper 5 and the abutting portion 81*a* of the lever member 81 are separated from each other, and the lever member 81 pivots to the initial position by the biasing force of the biasing member 84. As a result, the engaging portions 85*a* and 81*b* engage with each other. After that, the lower clamping unit 2 moves upward up to an upward movement upper limit while maintaining an engaging state of the engaging portions 85*a* and 81*b*.

When the lower clamping unit 2 is moved downward, the engaging mechanism 8 operates in an order of the state ST13→state ST12→state ST11, thus releasing the engaging state. That is, in the state ST12, the stopper 5 is brought into contact with the abutting portion 81*a* of the lever member 81, and the lever member 81 pivots from the initial position to the contact position. As a result, engagement between the engaging portions 85*a* and 81*b* is released.

Figure 7:
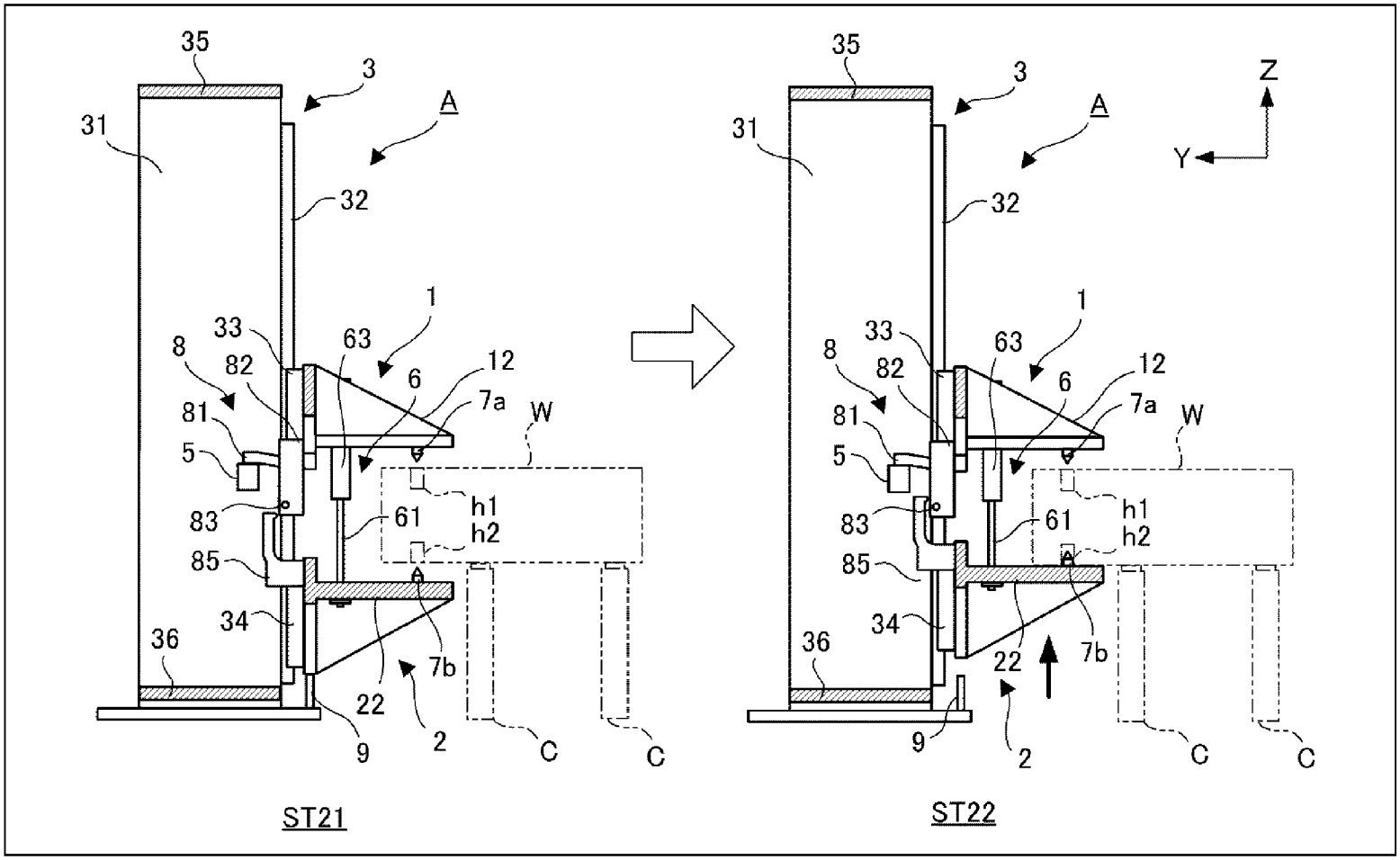
FIG. 7 is an operation explanatory view of the lifting apparatus.
Figure 8:
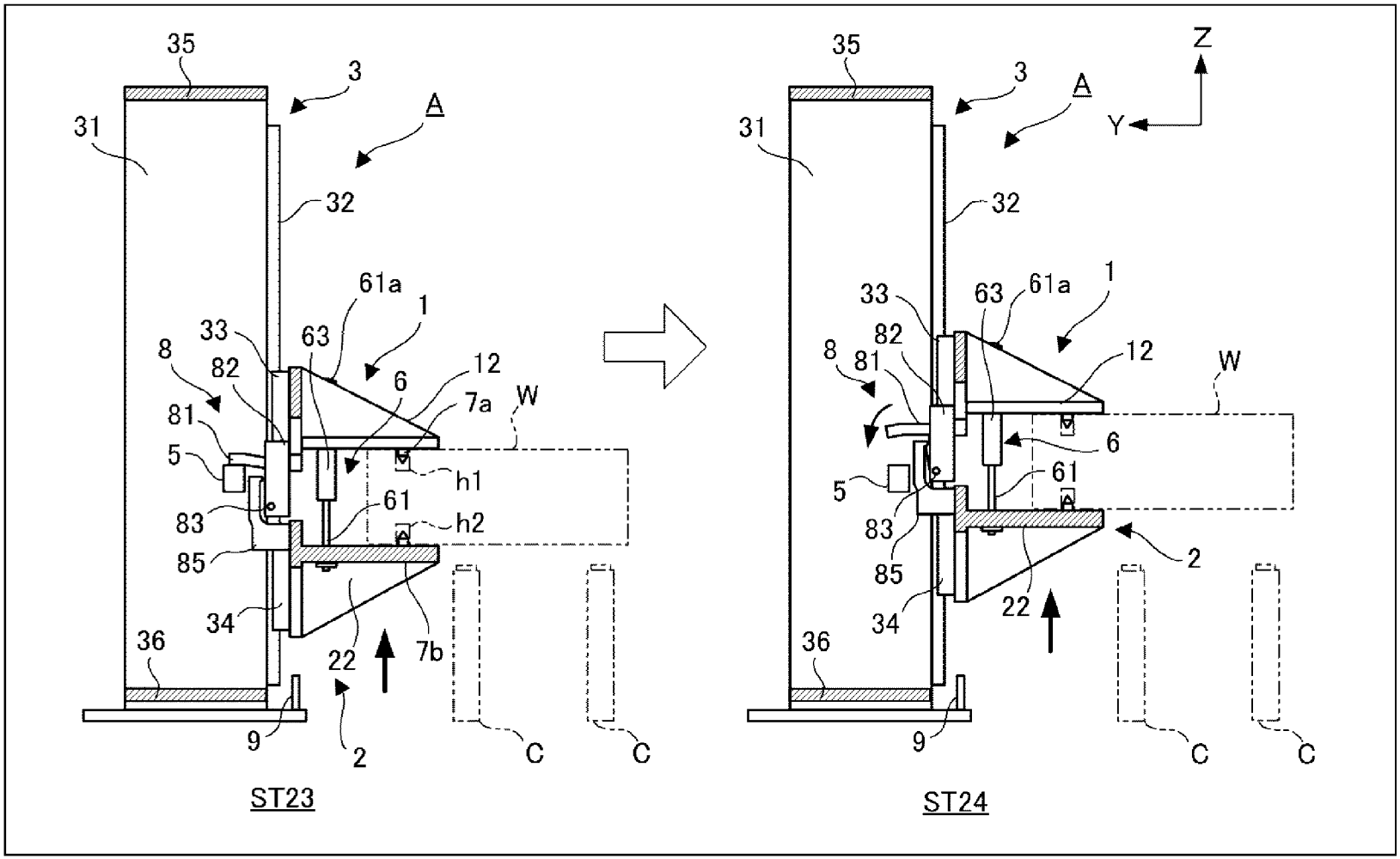
FIG. 8 is an operation explanatory view of the lifting apparatus.
Figure 9:
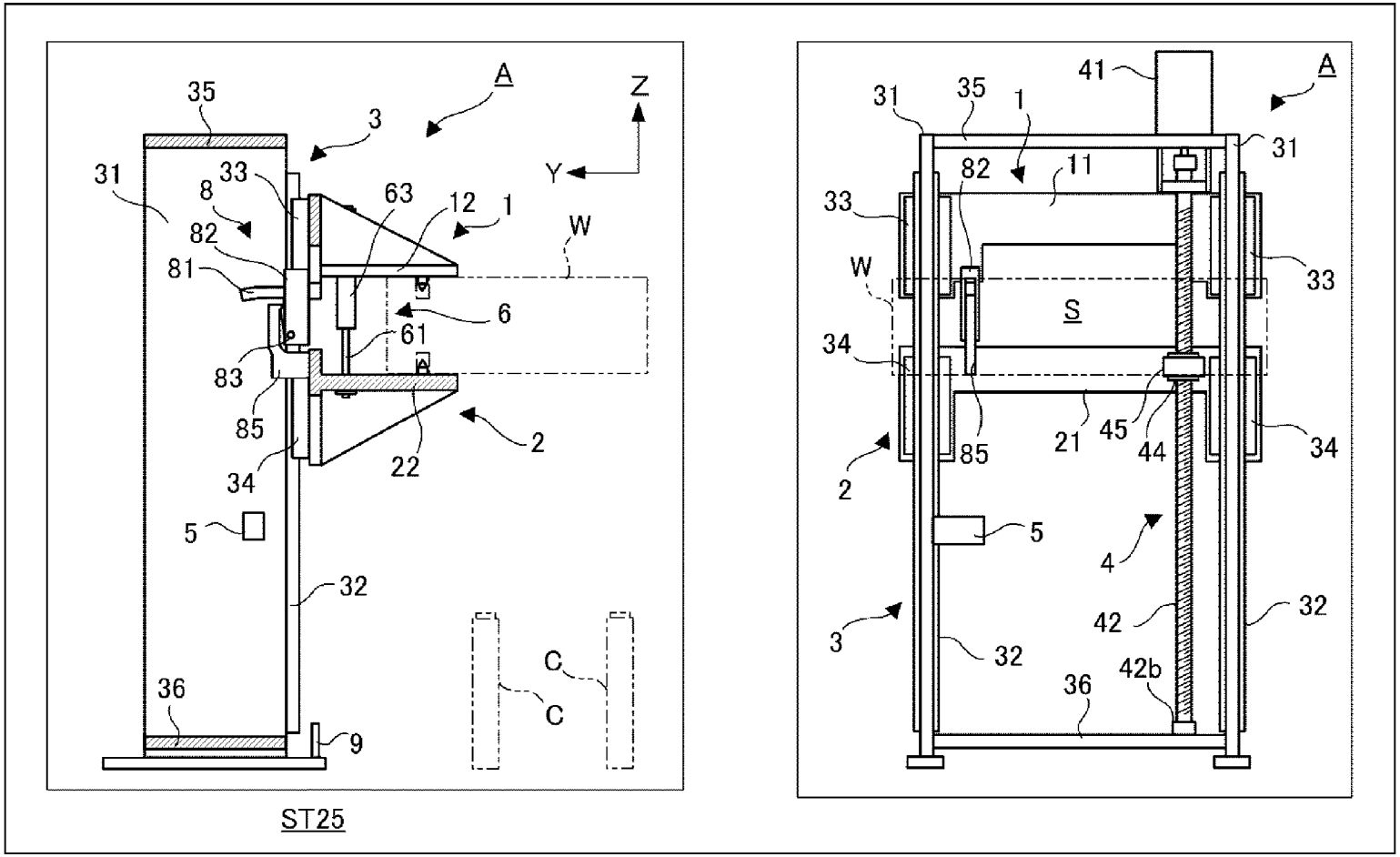
FIG. 9 is an operation explanatory view of the lifting apparatus.

An operation example of the lifting apparatus A will be described below with reference to FIGS. 7 to 9. FIGS. 7 to 9 are operation explanatory views of the lifting apparatus A, and states ST21 to ST25 correspond to a sectional view taken along a line II-II of FIG. 1 except for the right view (back view) of FIG. 9. A case will be described below wherein the work W is uplifted from the conveyors C, and is lifted toward an upward movement upper limit.

The state ST21 indicates a state in which both the upper clamping unit 1 and lower clamping unit 2 are located at their downward movement lower limits (the same state as in FIGS. 1 to 4). The coupling mechanism 6 is in the state ST1 (FIG. 5), and the engaging mechanism 8 is in the state ST11 (FIG. 6). The upper clamping unit 1 and lower clamping unit 2 are vertically separated apart from each other so as not to interfere with the work W on the conveyors C.

When the work W is conveyed by the conveyors C, and is positioned at a predetermined position between the abutting portions 12 and 22, the driving unit 41 of the driving mechanism 4 is activated to start an upward movement of the lower clamping unit 2. The positioning portion 7*b* is inserted into the holes h2 during the upward movement of the lower clamping unit 2 to half-complete positioning of the work W, and the work W is placed on the upper surface of the abutting portion 22 (state ST22). In the state ST22, the coupling mechanism 6 is in an intermediate state between the states ST1 and ST2 in FIG. 5, and the engaging mechanism 8 is in an intermediate state between the states ST11 and ST12 in FIG. 6.

When the lower clamping unit 2 further moves upward, the work W is uplifted from the conveyors C, the positioning portion 7*a* of the upper clamping unit 1 are inserted into the holes h1 to complete positioning of the work W, and the work W is brought into contact with the lower surfaces of the abutting 11 portion 12 and 22 (state ST23). In the state ST22, the coupling mechanism 6 is in the state ST2 in FIG. 5, and the engaging mechanism 8 is in the state ST12 in FIG. 6.

When the lower clamping unit 2 further moves upward, the lower clamping unit 2, work W, and upper clamping unit 1 move upward integrally (state ST24). In the state ST24, the coupling mechanism 6 is in the state ST2 in FIG. 5, and the engaging mechanism 8 is in the state ST13 in FIG. 6. That is, the upper clamping unit 1 and lower clamping unit 2 are mechanically engaged with each other by the engaging mechanism 8.

When the lower clamping unit 2 further moves upward, the lower clamping unit 2, work W, and upper clamping unit 1 move upward integrally, and reach an upward movement upper limit (state ST25). After that, an operation machine (not shown) arranged on the back surface side of the lifting apparatus A executes an operation for the work. The right view of FIG. 9 is a back view of the lifting apparatus A in the state ST25, and the operation machine (not shown) can access the work W via a space S bounded by the upper clamping unit 1, lower clamping unit 2, support member 82, engaging member 85, and ball screw shaft 42. As described above, in this embodiment, since the guide mechanism 3 adopts the double-mast type structure, and the ball screw shaft 42 is arranged not at the center between the pair of column portions 31 but at a position closer to one column portion 31 side, the large space S can be assured, and a portion on the back side of the work W can be operated over a broad range.

After completion of the operation, the lower clamping unit 2, work W, and upper clamping unit 1 move downward to return the work W onto the conveyors C. The sequence in this case is opposite to that at the time of the upward movement. When the driving unit 41 is activated to only move the lower clamping unit 2 to its downward movement lower limit, the downward movement of the upper clamping unit 1 is stopped by the stopper 5, engagement between the upper clamping unit 1 and lower clamping unit 2 by the engaging mechanism 8 is released, and the work W is placed on the conveyors C.

What is claimed is:

1. A lifting apparatus for holding a work by clamping the work vertically, and lifting the work, said apparatus comprising:

an upper clamping unit configured to be brought into contact with the work from above;

a lower clamping unit configured to be brought into contact with the work from below;

a guide mechanism configured to guide each lifting movement of the upper clamping unit and the lower clamping unit;

a driving mechanism configured to drive the lower clamping unit to lift along the guide mechanism;

an engaging mechanism configured to engage the upper clamping unit and the lower clamping unit;

a rod extending in a vertical direction so as to pass through the upper clamping unit, the rod having a lower portion attached to the lower clamping unit;

a biased portion on an upper portion of the rod, the upper portion protruding from the upper clamping unit; and a biasing member between the biased portion and the upper clamping unit, and configured to bias the biased portion and the upper clamping unit in a direction to be separated from each other, wherein the engaging mechanism includes:

a support member fixed to the upper clamping unit;

a lever member pivotally supported by the support member; and an engaging member fixed to the lower clamping unit, the engaging member includes a first engaging portion, the lever member includes a second engaging portion, and the first engaging portion and the second engaging portion are mechanically engaged with each other by the lifting movement of the lower clamping unit.

2. The lifting apparatus according to claim 1, wherein the guide mechanism comprises:

a pair of column portions which stand to be spaced apart from each other in a right-left direction;

rail portions which are respectively arranged for the pair of column portions, and extend in a vertical direction; and sliders which are respectively arranged at two end portions in the right-left direction of the upper clamping unit and the lower clamping unit, engage with the rail portions, and slide along the rail portions.

3. The lifting apparatus according to claim 2, wherein the rail portions comprise rail members common to the sliders arranged on the upper clamping unit and the sliders arranged on the lower clamping unit.

4. The lifting apparatus according to claim 1, further comprising a stopper configured to be set so that the upper clamping unit is stopped before the lower clamping unit reaches a downward movement lower limit during the downward movement of the upper clamping unit and the lower clamping unit, and configured to define a downward movement lower limit of the upper clamping unit;

wherein the lever member is pivotal upward from an initial position where the second engaging portion is engaged with the first engaging portion; and the engaging mechanism includes a second biasing member which biases the lever member to the initial position, the lever member includes an abutting portion which abuts against the stopper, and when the abutting portion abuts against the stopper, the lever member is configured to pivot upward from the initial position, to release engagement of the second engaging portion with the first engaging portion.

5. The lifting apparatus according to claim 1, wherein the biased portion is a flange member provided to the upper portion of the rod, and the biasing member is an elastic member in which the rod is inserted.

6. The lifting apparatus according to claim 5, further comprising a bottomed cylinder which is attached to the upper clamping unit, in which the rod and the flange member are inserted, and which houses the elastic member in an inner space thereof.

7. The lifting apparatus according to claim 6, comprising a sensor configured to detect a position of the flange member with respect to the cylinder.

8. The lifting apparatus according to claim 1, comprising positioning portions which are respectively arranged on the upper clamping unit and the lower clamping unit and engage with the work.

9. The lifting apparatus according to claim 1, wherein the lifting apparatus is free of a driving mechanism for lifting the upper clamping unit, the upper clamping unit lifts integrally with the lower clamping unit within a predetermined range, and the lifting apparatus further comprises a stopper configured to be set so that the upper clamping unit is stopped before the lower clamping unit reaches a downward movement lower limit during the downward movement of the upper clamping unit and the lower clamping unit, and configured to define a downward movement lower limit of the upper clamping unit.

* * * * *